US010629389B2

(12) United States Patent
McGuire

(10) Patent No.: US 10,629,389 B2
(45) Date of Patent: Apr. 21, 2020

(54) LATCHING RELAY AND METHOD THEREOF

(71) Applicant: Patrick L. McGuire, Oakland, CA (US)

(72) Inventor: Patrick L. McGuire, Oakland, CA (US)

( * ) Notice: Subject to any disclaimer, the term of this patent is extended or adjusted under 35 U.S.C. 154(b) by 103 days.

(21) Appl. No.: 15/815,797

(22) Filed: Nov. 17, 2017

(65) Prior Publication Data

US 2019/0157018 A1 May 23, 2019

(51) Int. Cl.
*H01H 3/56* (2006.01)
*H01H 11/00* (2006.01)
*H01H 51/28* (2006.01)

(52) U.S. Cl.
CPC ..... *H01H 3/56* (2013.01); *H01H 11/00* (2013.01); *H01H 11/005* (2013.01); *H01H 51/285* (2013.01)

(58) Field of Classification Search
CPC ..... H01H 3/56; H01H 11/00; H01H 11/005; H05B 37/00; H05B 37/0227; H05B 37/0272
USPC ..... 307/132, 66, 64, 68, 129, 117, 115; 607/65, 63
See application file for complete search history.

(56) References Cited

U.S. PATENT DOCUMENTS 3,263,134 A 7/1966 Grobe
3,708,727 A 1/1973 Wielebski et al.
3,949,334 A 4/1976 Launt
3,959,758 A 5/1976 Grobe
4,071,840 A 1/1978 Jammes et al.
5,815,057 A * 9/1998 Hoffman ..... H01H 51/2209 335/179
8,907,754 B2 12/2014 Barton et al.
9,934,924 B2 * 4/2018 Liang ..... H01H 50/643
2002/0086152 A1 * 7/2002 Gambino ..... H01F 1/0027 428/327
2004/0263347 A1 * 12/2004 Yasui ..... H02J 1/00 340/12.19
2005/0052265 A1 * 3/2005 Vladimirescu ..... H01F 7/1615 335/229
2005/0104474 A1 5/2005 Srinivasan
2007/0279165 A1 12/2007 Gilmore
2008/0129059 A1 6/2008 Chang
(Continued)

FOREIGN PATENT DOCUMENTS

CN 2107060 U 6/1992
CN 104051190 A 9/2014

OTHER PUBLICATIONS

Notification of Transmittal of the International Search Report and the Written Opinion of the International Searching Authority dated Feb. 1, 2019, in connection with corresponding international Application No. PCT/US2018/61207 (9 pgs.).

*Primary Examiner* — Rexford N Barnie
*Assistant Examiner* — Jagdeep S Dhillon
(74) *Attorney, Agent, or Firm* — Maier & Maier, PLLC

(57) ABSTRACT

A latching relay may be shown and described. The latching relay may use a reed switch, a permanent magnet and a coil. The permanent magnet may be magnetized by pulsing current through the coil, and demagnetized by degaussing current. Also, the magnetized magnet may maintain an activated state of the reed switch, and the demagnetized magnet may maintain a deactivated state of the reed switch.

19 Claims, 3 Drawing Sheets

(56) References Cited

U.S. PATENT DOCUMENTS

| | | | | |
|---|---|---|---|---|
| 2009/0163980 | A1* | 6/2009 | Stevenson | A61N 1/3718 607/63 |
| 2009/0163981 | A1* | 6/2009 | Stevenson | A61N 1/025 607/63 |
| 2010/0176665 | A1* | 7/2010 | Shen | H02K 33/16 310/36 |
| 2015/0340184 | A1 | 11/2015 | Kamiya et al. | |
| 2016/0012993 | A1* | 1/2016 | Sasaki | H01H 51/01 335/203 |
| 2016/0086754 | A1 | 3/2016 | Shimoda | |
| 2017/0086281 | A1* | 3/2017 | Avrahamy | C02F 1/42 |
| 2017/0236669 | A1 | 8/2017 | Tarzwell | |

* cited by examiner

LATCHING RELAY AND METHOD THEREOF

BACKGROUND

A latching (bistable) relay is a switch which can maintain either an activated state or a deactivated state indefinitely without additional power consumption, and the latching relay consumes power only when the relay is switched. Conventional latching relays often use a permanent magnet to produce part of the magnetic force which is required for the activated state or the deactivated state. Also, the latching relay may have a coil to supply sufficient force for the activated or deactivated state by aiding or opposing the magnetic field of the permanent magnet. Once the relay switches, an additional magnetic field is not required to sustain the switched state. However, the latching relay requires careful magnet level biasing, which can be cumbersome.

Conventional latching reed relays also use the permanent magnet approach to bias the magnetic circuit. A "forward" current pulse through the coil increases the permanent magnet's field strength to activate the relay contacts. Once activated, the permanent magnet maintains the closure. To deactivate the contacts, a "reverse" current pulse is applied to cancel the permanent magnet's field. The contacts are deactivated and remain so because the permanent magnet, in the absence of any coil current, is too weak to activate the contacts.

The selection and placement of that magnet are crucial in the conventional latching reed relay. In some manufacturing environments, graded magnets are selected for a given reed. It can be a problem when attempting to select and place a bias magnet for two reed switches in a double-pole relay. Another approach, using two bias magnets, one for each reed switch, is equally difficult because of magnetic field interaction.

SUMMARY

Exemplary embodiments described herein generally relate to a latching relay and its method, and, more specifically, to the latching relay and its method which use a single pulse of current to magnetize and a degaussing current to demagnetize the permanent magnet of the latching relay.

Such a latching relay may include: at least one permanent magnet; at least one coil winding around the at least one permanent magnet; and at least one contact switch being provided next the at least one permanent magnet. According to an exemplary embodiment, the at least one permanent magnet is magnetized by a single pulse of current which is of either polarity, and demagnetized by a degaussing current which is applied to the at least one coil, and the at least one contact switch is deactivated when the at least one permanent magnet is demagnetized.

Another exemplary embodiment can describe a method for the latching relay. The method may include applying a degaussing current to at least one coil. According to an exemplary embodiment, the at least one coil winds around at least one permanent magnet, and at least one contact switch is provided next the at least one permanent magnet. Also, in an exemplary embodiment, the at least one permanent magnet is demagnetized by the degaussing current, and the at least one contact switch is deactivated when the at least one permanent magnet is demagnetized.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Generally referring to Figures, a latching relay is described. According to an exemplary embodiment, the latching relay may use a reed switch, a permanent magnet, and a coil. The permanent magnet may be magnetized by pulsing current through the coil, and demagnetized by degaussing current. Also, in an exemplary embodiment, the magnetized magnet may maintain an activated state of the reed switch, and the demagnetized magnet may maintain a deactivated state of the reed switch.

Figure 1A:
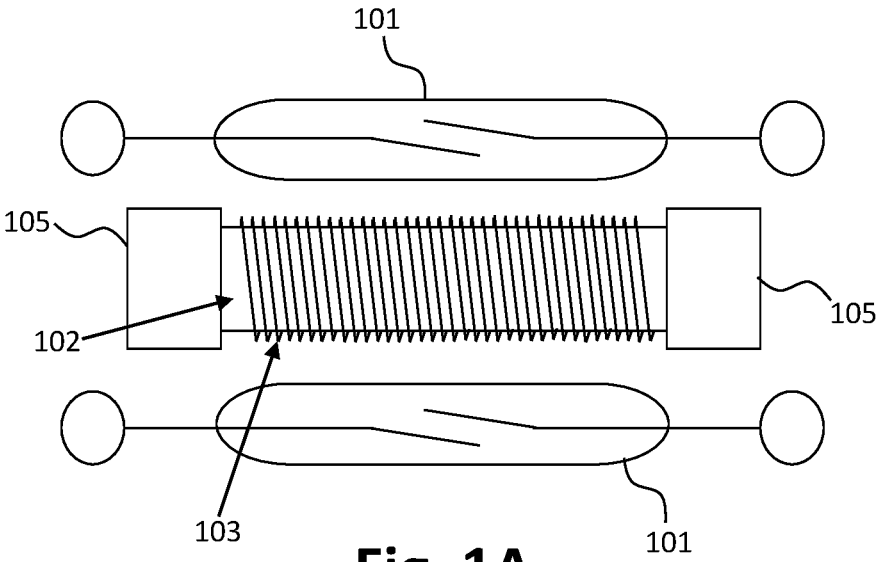
FIG. 1A is a top view of an exemplary embodiment of a double pole latching relay.
Figure 1B:
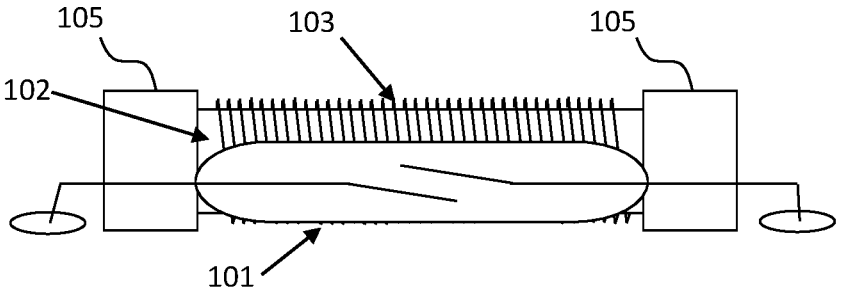
FIG. 1B is a side view of the double pole latching relay.
Figure 1C:
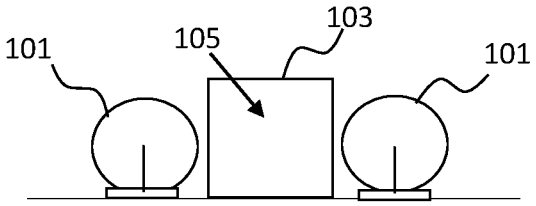
FIG. 1C is another side view of an end of the double pole latching relay.

In exemplary FIGS. 1A, 1B and 1C, an exemplary embodiment of a latching relay may be shown. FIG. 1A may show the top view of the latching relay, FIG. 1B may show the side view of the latching relay, and FIG. 1C may show another side view of the end of the latching relay.

According to an exemplary embodiment, a reed switch 101 may be located next to a permanent magnet 102 which a coil 103 winds around, as shown in FIGS. 1A and 1B, like an inductor, to magnetize or demagnetize the permanent magnet 102. Also, in an exemplary embodiment, the single pulse of current or degaussing pulse of current may be supplied to the coil 103 for the magnetizing or the demagnetizing. A magnetized end caps 105 may be used for soldering of the coil 103.

The permanent magnet 102 may be any material which has high coercivity and high remanence such as Alnico, Strontium Ferrite ($SrFe_{12}O_{19}$), Barium Ferrite ($BaFe_{12}O_{19}$), Cobalt Ferrite ($CoFe_2O_4$), or the like. Also, the coil 103 which is used as an inductor may be replaced with any other material which may demagnetize the permanent magnet 102 by using the degaussing. Further, the reed switch 101 may be any contact or contact assembly which can be switched with the magnetic field of the permanent magnet 102.

Also, the exemplary FIGS. 1A, 1B and 1C shows a DPST (double pole, single throw) switch as an example, but those skilled in the art will recognize that any alternate types of a switch may be devised without departing from the spirit or the scope of the embodiments described herein. For example, one or more reed switches can be used in the latching relay. Also, generally, "open" and "closed" may indicates the relay (contact) state, yet, the relay may be of the "double throw" or "changeover" type where a common pole is connected to one contact in the unenergized state and a second contact in the energized state. For example, a "Form C" or SPDT (single pole, double throw) reed switch may be used without departing from the spirit or the scope of the embodiments of the latching relay.

Figure 2A:
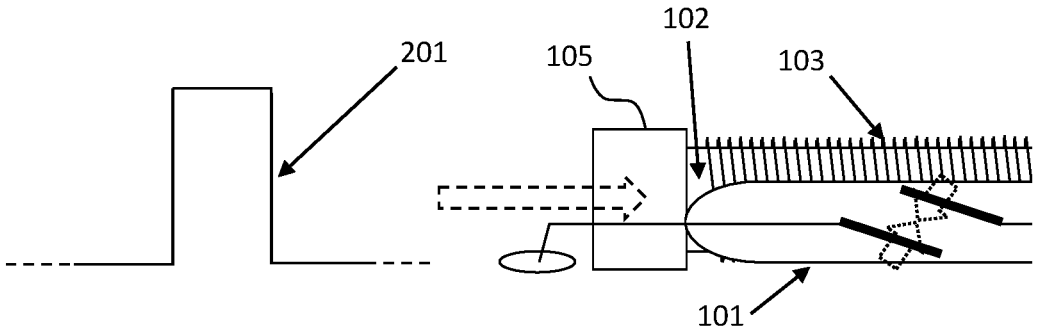
FIG. 2A shows an activation of a reed switch in the latching relay.
Figure 2B:
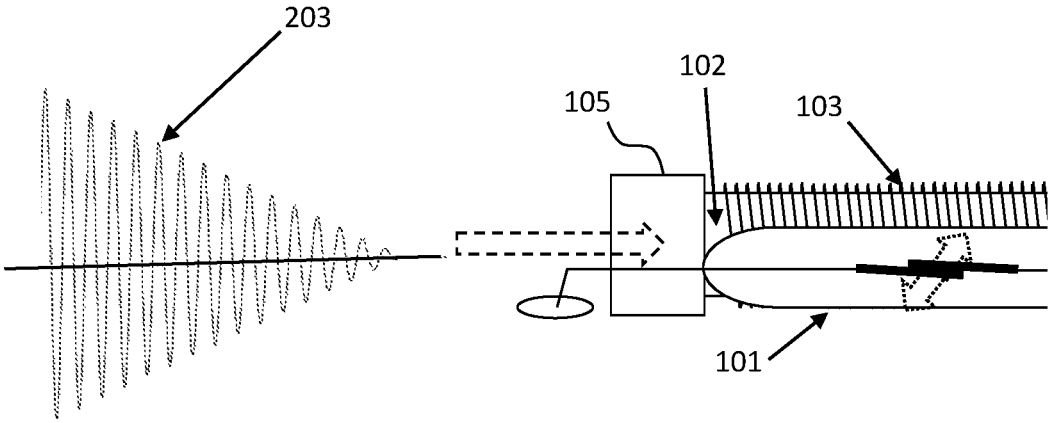
FIG. 2B shows a deactivation of the reed switch in the latching relay.

Turing now to exemplary FIGS. 2A and 2B, operations of the latching relay may be described as an example. According to an exemplary embodiment, in the quiescent or non-energized state, the permanent magnet 102 of the latching relay may be fully demagnetized. Then, to operate or energize the relay, as shown in FIG. 2A, a current pulse 201 may be applied to the coil 103 of the latching relay around or in proximity to the permanent magnet 102 so that the magnetized permanent magnet 102 can activate the reed switch 101. The permanent magnet will remain magnetized thereafter and the relay is in permanent operation as the activated state.

Unlike a conventional bistable relay (latching relay), a current pulse of opposite polarity is not required to be used to deactivate the relay because the permanent magnet 102 would simply end up magnetized in the opposite polarity, which would continue to activate the relay (the reed switch 101 would be still activated). Instead, according to an exemplary embodiment, a degaussing waveform 203 may be applied to the coil 103 to demagnetize the permanent magnet 102 deactivating the reed switch 101. In the absence of any residual magnetic field, the latching relay may deactivate and remains in a deactivated state so until the permanent magnet 102 is re-magnetized.

Figure 3:
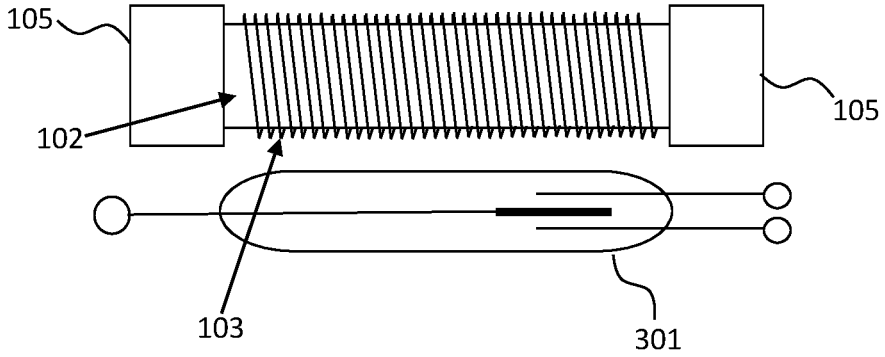
FIG. 3 shows exemplary SPDT (single pole, double throw) reed switch latching relay.

According to another exemplary embodiment, depending on the type of the reed switch, the latching relay may be the deactivated state when the permanent magnet is magnetized, and the activated state when demagnetized. Also, as described above, the states of the relay may be of the "double throw" or "changeover" type where a common pole is connected to one contact in the unenergized state and a second contact in the energized state, for example, in a case of a "Form C" or SPDT (single pole, double throw) reed switch 301 which is shown in exemplary FIG. 3.

Figure 4:
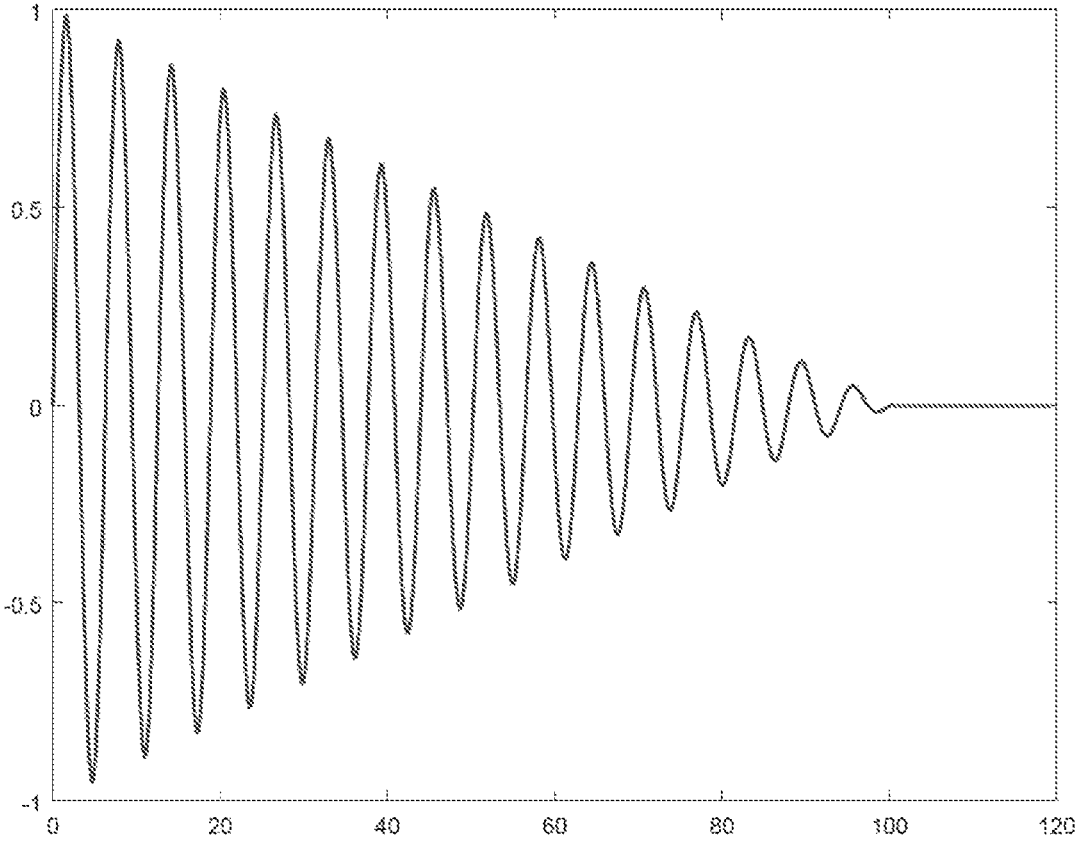
FIG. 4 shows an exemplary degaussing waveform used for the latching relay.

Turing to exemplary FIG. 4, the degaussing wave form which is used in the demagnetizing is shown as an example. According to an exemplary embodiment, as shown in FIG. 4, a linearly decaying sine wave may be used as a degaussing wave form. In an exemplary embodiment, to deactivate the latching relay rapidly, a highly fast degaussing waveform may be used, for example, each degaussing pulse (of current, from a current source) may be within 300 μsec. Also, in an exemplary embodiment, in demagnetizing, 16 successively diminishing pulses of opposite polarity may be used, as an example. Further, for example, the demagnetizing may take 2-4 ms, and the magnetizing may take less than 1 ms. Thus, deactivating or activating of the latching relay may be performed rapidly.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A latching relay, comprising:

at least one fixedly placed permanent magnet;

at least one coil winding around the at least one permanent magnet, wherein the at least one coil is connected to at least one magnetized end cap, and wherein the at least one magnet maintains the same position with respect to the latching relay; and at least one contact switch provided next to the at least one permanent magnet, wherein the at least one permanent magnet is demagnetized by a diminishing, high frequency, alternating degaussing current which is applied to the at least one coil, wherein the at least one contact switch is switched to a first state in the absence of a magnetic field when the at least one permanent magnet is demagnetized, wherein the at least one permanent magnet is magnetized by a single current pulse, of either polarity, which is applied to the at least one coil, and the at least one contact switch is switched to a second state when the at least one permanent magnet is magnetized.

2. The latching relay of claim 1, wherein the at least one contact switch is magnetically activated.

3. The latching relay of claim 1, wherein the at least one contact switch is a reed switch.

4. The latching relay of claim 1, wherein the at least one permanent magnet is Alnico.

5. The latching relay of claim 1, wherein the at least one permanent magnet is Strontium Ferrite ($SrFe_{12}O_{19}$).

6. The latching relay of claim 1, wherein the at least one permanent magnet is Barium Ferrite ($BaFe_{12}O_{19}$).

7. The latching relay of claim 1, wherein the at least one permanent magnet is Cobalt Ferrite ($CoFe_2O_4$).

8. The latching relay of claim 1, wherein the contact switch is two reed switches which are provided on both sides of the permanent magnet to function as a DPST (double pole, single throw) switch.

9. The latching relay of claim 1, wherein the contact switch is a SPDT (single pole, double throw) reed switch with which types of the latching relay includes a double throw type or a changeover type.

10. The latching relay of claim 1, wherein the degaussing current is a plurality of magnetizing pulses which successively diminish in an opposite polarity.

11. A method for providing a latching relay, comprising:

winding at least one coil around at least one fixedly placed permanent magnet, wherein the at least one coil is connected to at least one magnetized end cap, and wherein the at least one magnet maintains the same position with respect to the latching relay;

providing at least one contact switch next to the at least one permanent magnet, magnetizing the at least one permanent magnet by a single pulse current, of either polarity, which is applied to the at least one coil;

switching the at least one contact switch to a first state in the absence of a magnetic field when the at least one permanent magnet is magnetized;

demagnetizing the at least one permanent magnet by applying a degaussing current to the at least one coil; and switching the at least one contact switch to a second state when the at least one permanent magnet is demagnetized.

12. The method of claim 11, wherein the at least one contact switch is a reed switch.

13. The method of claim 11, wherein the at least one permanent magnet is Alnico.

14. The method of claim 11, wherein the at least one permanent magnet is Strontium Ferrite ($SrFe_{12}O_{19}$).

15. The method of claim 11, wherein the at least one permanent magnet is Barium Ferrite ($BaFe_{12}O_{19}$).

16. The method of claim 11, wherein the at least one permanent magnet is Cobalt Ferrite ($CoFe_2O_4$).

17. The method of claim 11, wherein the contact switch is two reed switches which are provided on both sides of the permanent magnet functioning as a DPST (double pole, single throw) switch.

18. The method of claim 11, wherein the degaussing current is a plurality of magnetizing pulses which successively diminish in an opposite polarity.

19. A latching relay, comprising:

at least one fixedly placed permanent magnet;

at least one coil winding around the at least one permanent magnet, wherein the at least one coil is connected to at least one magnetized end cap, and wherein the at least one magnet maintains the same position with respect to the latching relay; and at least one reed switch provided next to the at least one permanent magnet, wherein the at least one permanent magnet is demagnetized by a diminishing, high frequency, alternating degaussing current which is applied to the at least one coil, wherein the at least one contact switch is switched to a first state in the absence of a magnetic field when the at least one permanent magnet is demagnetized, wherein the at least one permanent magnet is magnetized by a single current pulse, of either polarity, which is applied to the at least one coil, and the at least one contact switch is switched to a second state when the at least one permanent magnet is magnetized.

* * * * *